US012503853B2

(12) United States Patent
Crumley

(10) Patent No.: US 12,503,853 B2
(45) Date of Patent: Dec. 23, 2025

(54) ADJUSTABLE LATERAL BRACE

(71) Applicant: Harvel Crumley, Jacksonville, FL (US)

(72) Inventor: Harvel Crumley, Jacksonville, FL (US)

( * ) Notice: Subject to any disclaimer, the term of this patent is extended or adjusted under 35 U.S.C. 154(b) by 201 days.

(21) Appl. No.: 18/472,732

(22) Filed: Sep. 22, 2023

(65) Prior Publication Data

US 2024/0102285 A1 Mar. 28, 2024

Related U.S. Application Data

(60) Provisional application No. 63/409,100, filed on Sep. 22, 2022.

(51) Int. Cl.

| | |
|---|---|
| ***E04C 3/02*** | (2006.01) |
| ***E04C 3/09*** | (2006.01) |
| *E04B 1/26* | (2006.01) |

(52) U.S. Cl.

CPC ..... *E04C 3/02* (2013.01); *E04C 3/09* (2013.01); *E04B 2001/2696* (2013.01); *E04C 2003/026* (2013.01)

(58) Field of Classification Search

CPC ..... E04C 3/02; E04C 2003/026; E04C 3/09; E04B 2001/2696

USPC ..... 52/831, 842, 693, 696

See application file for complete search history.

(56) References Cited

U.S. PATENT DOCUMENTS

| | | | | |
|---|---|---|---|---|
| 2,865,059 | A * | 12/1958 | Scriven | E04C 3/02 52/695 |
| 4,414,785 | A * | 11/1983 | Howell | E04B 1/2608 52/713 |
| 5,197,818 | A * | 3/1993 | Johnson | E04B 1/19 403/217 |
| 5,524,854 | A | 6/1996 | McSwain et al. | |
| 5,606,837 | A | 3/1997 | Holtzlander | |
| 6,170,218 | B1 | 1/2001 | Shahnazarian | |
| 6,799,406 | B2 * | 10/2004 | Gosselin | B21D 47/04 52/696 |
| 7,677,071 | B2 | 3/2010 | Heirich | |
| 8,756,895 | B1 | 6/2014 | Sidhu et al. | |
| 8,966,856 | B2 * | 3/2015 | Groenesteyn | E04H 9/0237 52/657 |
| 9,290,926 | B2 * | 3/2016 | Sidhu | E04B 1/2612 |
| 9,404,257 | B2 | 8/2016 | Reno | |
| 9,903,118 | B2 | 2/2018 | Ventling | |
| 9,920,542 | B1 | 3/2018 | Koetter | |
| 10,422,136 | B2 | 9/2019 | Leblang | |
| 11,066,824 | B2 | 7/2021 | Hansort | |

(Continued)

FOREIGN PATENT DOCUMENTS

EP 3255217 A1 12/2017

*Primary Examiner* — Brent W Herring

(74) *Attorney, Agent, or Firm* — Stephen E. Kelly; Hill Ward Henderson P.A.

(57) ABSTRACT

An adjustable lateral brace configured for bracing adjacent roof trusses, wall studs, or similar structural elements during construction of residential and light commercial structures. The brace comprises a horizontal member and a diagonal member connected by a living hinge. The brace is shipped to a construction site in a compact configuration in which the horizontal member and vertical member are substantially parallel. The living hinge is activated to dispose the horizontal member and diagonal member at an acute angle adjusted to the spacing of the members to be braced.

20 Claims, 4 Drawing Sheets

(56) References Cited

U.S. PATENT DOCUMENTS

| | | | | |
|---|---|---|---|---|
| 2014/0311082 | A1* | 10/2014 | Sidhu | E04C 3/02 52/693 |
| 2016/0024791 | A1* | 1/2016 | Reno | E04C 3/02 52/745.21 |
| 2019/0338520 | A1 | 11/2019 | Goh | |
| 2022/0298791 | A1* | 9/2022 | Szymanski | E04C 3/04 |

* cited by examiner

ADJUSTABLE LATERAL BRACE

CROSS-REFERENCE TO RELATED APPLICATION

Pursuant to 35 U.S.C. § 119(e), this application claims the benefit of U.S. Provisional Patent Application Ser. No. 63/409,100, filed on Sep. 22, 2022, the entire contents of which are incorporated herein by this reference.

BACKGROUND

(1) Field of Endeavor

The present invention relates generally to the field of structural braces, and more particularly to adjustable lateral braces for bracing adjacent slender structural members.

(2) Description of Related Art

Past lateral braces for roof trusses have been generally available in standard configurations, ready for installation. These braces are bulky to ship to construction sites, and they are often awkward to install. In many instances, installation of prior adjacent roof trusses was susceptible to placement off-center or otherwise slightly misaligned. In these instances, fitting a pre-fabricated lateral brace to irregularly spaced roof trusses can be difficult or impossible.

The present adjustable lateral brace seeks to overcome these problems by providing a brace that is compact to ship, adjustable on-site to accommodate irregular spacing of structural members, and easy to install.

SUMMARY

The device is an adjustable lateral brace for adjacent structural members, the lateral brace comprising a horizontal member and a diagonal member connected by a hinge. In one embodiment, the horizontal member has a first end and a second end, each of the first end and the second end having a connection plate, the connection plate at the second end further comprising a first connection flange. The diagonal member has a first end and a second end, each of the first end and the second end having a connection plate, the connection plate at the second end further comprising a second connection plate. The hinge is an adjustable hinge operatively connecting the horizontal member and the diagonal member, the adjustable hinge begin disposed at an interface between the first connection flange and the second connection flange.

The adjustable lateral brace may be fabricated from a pattern disposed on a sheet of metal. The pattern may comprise fold lines that have a feature for promoting the folding action during a cold-forming process. The feature may comprise one or more of perforations, creases, grooves, indentations, or other such structures. In one embodiment of the fold lines comprise a v-shaped groove disposed along all or part of the fold line 6. The v-shaped groove is disposed in an orientation that is open in the intended direction of the fold to promote cold-forming the brace. In another embodiment, one or more of the fold lines comprise a perforated segment along all or part of the fold line to promote the folding action.

After flanges are cold-formed into the horizontal member and the diagonal member, the horizontal member and diagonal member may be separated in a scissor-like action to the precise dimensions of structural members on the job site. The angle of separation is adjustable at the job site to accommodate structural members that are installed off-center, misaligned, or otherwise define an irregular spacing.

DESCRIPTION OF THE PREFERRED EMBODIMENT

With reference to the drawings, the adjustable lateral brace will now be described with regard for the best mode and the preferred embodiment. In general, the device is a lateral brace for stabilizing adjacent roof trusses, wall studs, or other structural members in residential and light commercial construction. The embodiments disclosed herein are meant for illustration and not limitation of the invention. An ordinary practitioner will appreciate that it is possible to create many variations of the following embodiments without undue experimentation.

Figure 1:
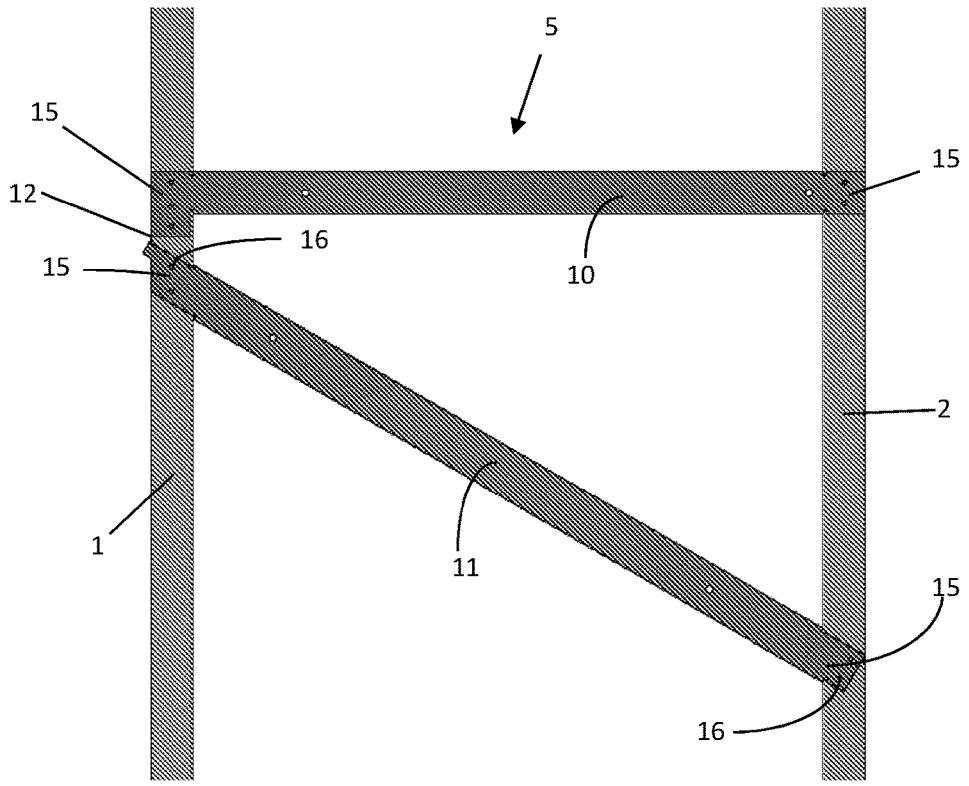
FIG. 1 is a plan view of one embodiment of the adjustable lateral brace attached to adjacent roof trusses.
Figure 3:
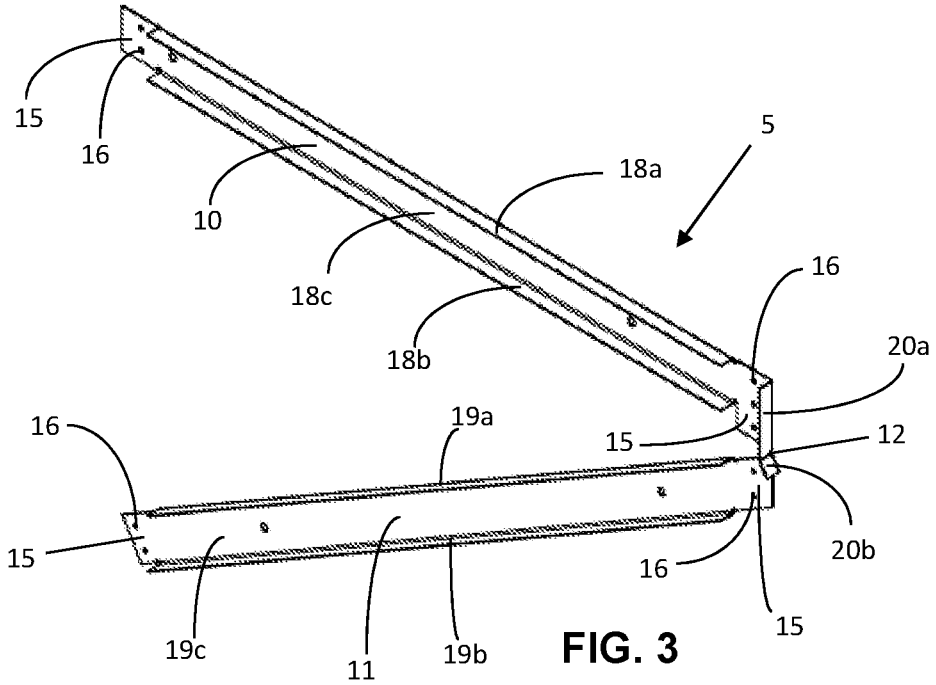
FIG. 3 is a perspective view of an embodiment of the adjustable lateral brace configured for installation.

An exemplary application of the adjustable lateral brace is in the construction of a sloped roof in residential or light commercial construction. Typical sloped roofs are supported with prefabricated roof trusses that need to be held in place during construction. In FIG. 1, roof trusses 1, 2 are stabilized by adjustable lateral brace 5. Referring to FIG. 3, the brace 5 comprises a horizontal member 10 and a diagonal member 11 connected by a hinge, such as a living hinge 12. The horizontal member 10 and the diagonal member 11 terminate on each end at connection plates 15 that have holes 16 for receiving one or more mechanical fasteners (not shown) for connecting the brace 5 to the first and second roof trusses 1, 2. Suitable mechanical fasteners include nails, screws, pins, staples, or the like. The brace 5 further comprises a first connection flange 20*a* connected to a connection plate 15 at an end of the horizontal member 10, and a second connection flange 20*b* connected to a connection plate 15 at an end of the diagonal member 11, the interface between the first connection plate 20*a* and the second connection plate 20*b* comprising the hinge 12.

Figure 2:
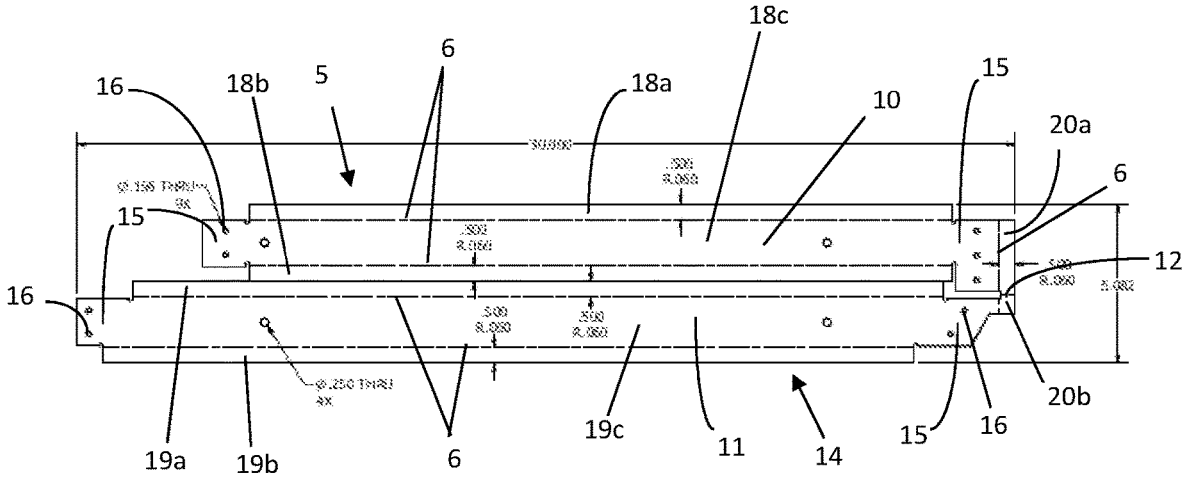
FIG. 2 is a plan view of one embodiment of a fold pattern for forming an adjustable lateral brace.
Figure 4:
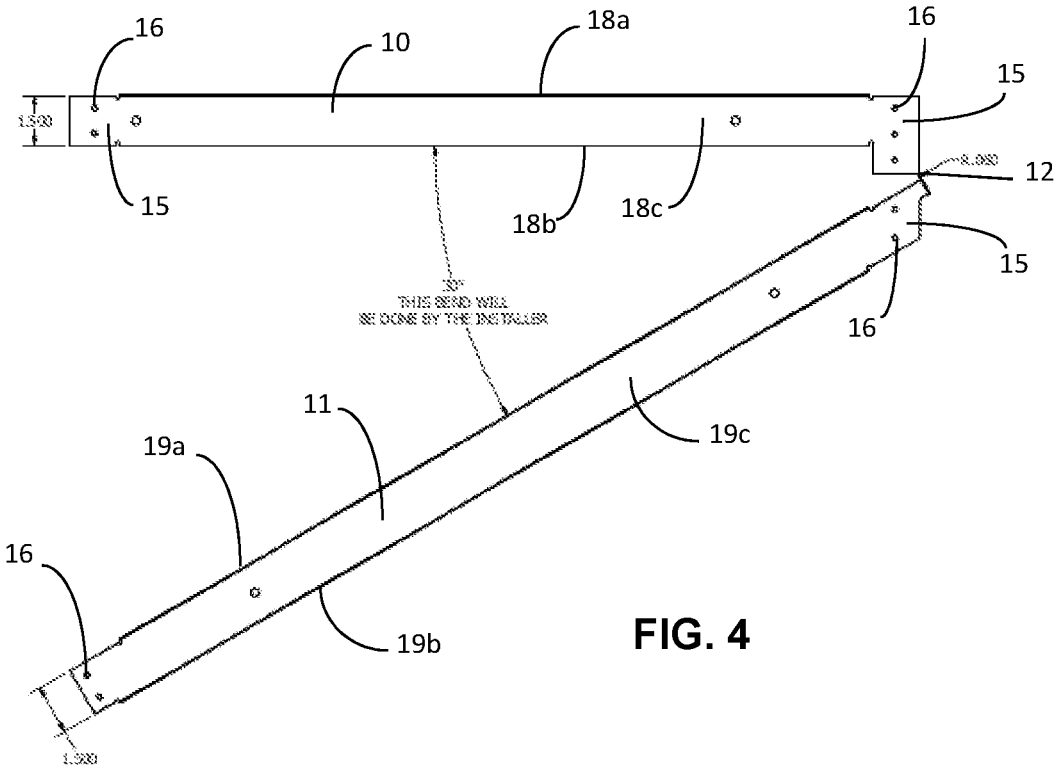
FIG. 4 is a side view of the adjustable lateral brace of FIG. 3.
Figure 5:
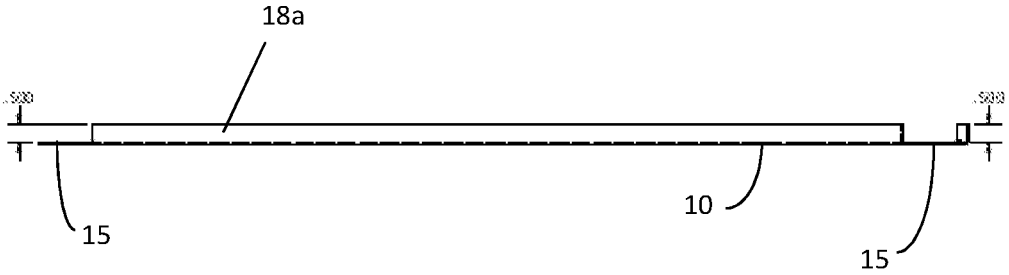
FIG. 5 is a top view of the adjustable lateral brace of FIG. 3.

FIG. 2 shows a pattern 14 for stamping the brace 5 out of a sheet of metal. Dashed lines on the pattern 14 indicate fold lines 6 for cold-forming the brace 5 shown in FIGS. 3 and 4. The fold lines 6 may comprise a feature for promoting the folding action described below. The feature may comprise one or more of perforations, creases, grooves, indentations, or other such structures. For example, one embodiment of the fold lines 6 comprise a v-shaped groove along all or part of the fold line 6, where the v-shaped groove is disposed in an orientation that is open in the intended direction of the fold to promote cold-forming the brace 5, as described below. In another embodiment, one or more of the fold lines 6 comprises a perforated segment along all or part of the fold line 6 to promote the folding action described below.

The pattern 14 shown in FIG. 3 may be stamped, cut, or otherwise separated from a flat sheet of metal. Once the shape of the pattern 14 is separated from the sheet metal, the pattern 14 is folded along the fold lines 6 indicated in FIG. 3 to define a first flange 18*a* and a second flange 18*b* on the horizontal member 10, separated by a horizontal member web 18*c*. The diagonal member 11 similarly has a first flange 19*a* and a second flange 19*b* separated by a diagonal member web 19*c*. In one embodiment, a fold line 6 divides the first and second connection flanges 20*a*, 20*b* from their respective connection plates 15 at the respective ends of the horizontal member 10 and the diagonal member 11. In an embodiment where the hinge 12 is a living hinge 12, the first and second connection flanges 20*a*, 20*b* are integrally connected by the living hinge 12. Optionally, another fold line 6 is disposed at the location of the living hinge 12 at the interface between the first and second connection flanges 20*a*, 20*b* to promote the folding action by the living hinge 12.

In one embodiment, the brace 5 is fabricated in a shop and then shipped with the horizontal member 10 and the diagonal member 11 disposed in a parallel orientation, similar to that shown in FIG. 2. Preferably, but not necessarily, the fold lines 6 are activated prior to shipping such that the flanges 18*a*, 18*b*, 19*a*, 19*b*, 20*a*, and 20*b* are disposed a position substantially perpendicular to the horizontal member web 18*c* and the vertical member web 19*c*, which are disposed in substantially the same plane. At the installation site, the installer separates the horizontal member 10 from the diagonal member 11 by activating the living hinge 12 such that the connection plates are properly disposed for connection to the first and second trusses 1, 2. This is demonstrated in the exemplary embodiment shown in FIG. 4, which indicates opening the brace 5 by a "scissor"-like action such that the horizontal member 10 and the vertical member 11 are disposed in approximately a 30-degree relation to each other.

Figure 6:
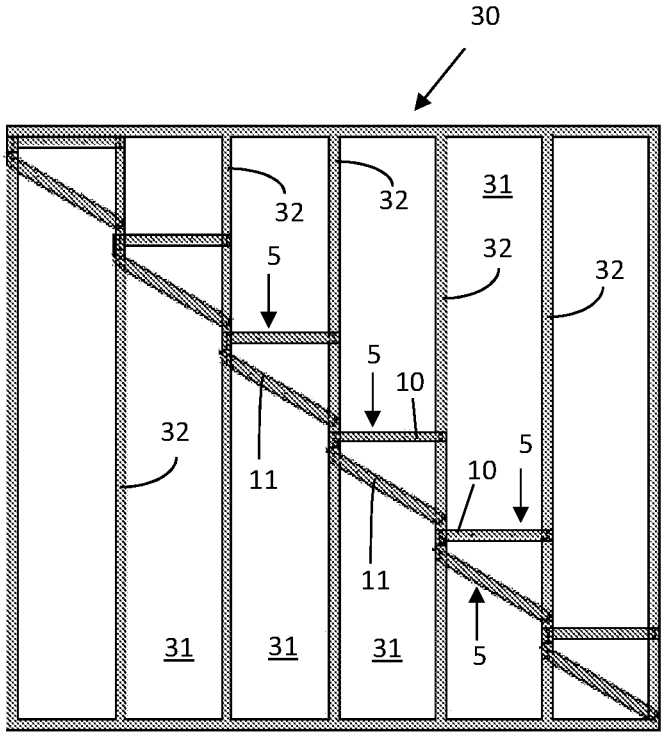
FIG. 6 is an elevation view of a shear wall having an embodiment of an adjustable lateral brace installed therein.
Figure 7:
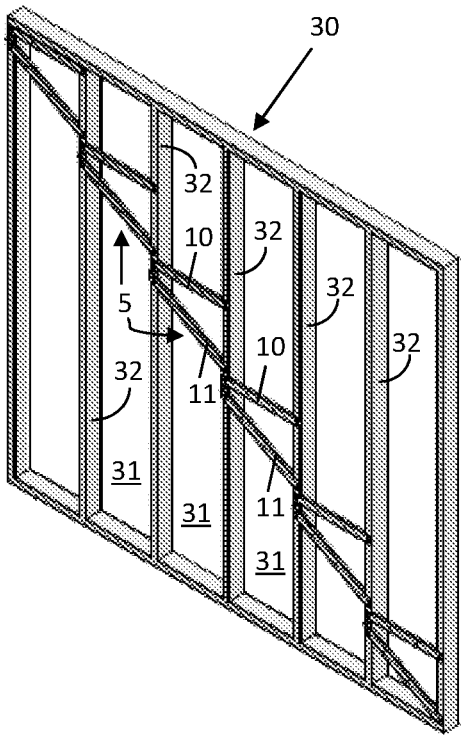
FIG. 7 is perspective view of a shear wall having an embodiment of an adjustable lateral brace installed therein.

Referring to FIGS. 6 and 7, one or more braces 5 may be installed in a vertical wall of a structure. The braces 5 may be installed in adjacent bays 31, in every other bay 31, or in some other arrangement. The braces 5 attach in the manner described above to adjacent wall studs disposed in the vertical wall. A vertical wall having multiple braces 5 installed therein may function as a shear wall 30, which resists shear forces applied to the structure. In one embodiment, to promote connectivity, the braces 5 installed in adjacent bays 31 may be installed at different heights in the shear wall 30.

The foregoing embodiments are merely representative of the adjustable lateral brace and not meant for limitation of the invention. For example, persons skilled in the art would readily appreciate that there are several embodiments and configurations of flanges and connection members that will not substantially alter the nature of the lateral brace. Consequently, it is understood that equivalents and substitutions for certain elements and components set forth above are part of the invention described herein, and the true scope of the invention is set forth in the claims below.

I claim:

1. An adjustable lateral brace for adjacent structural members, the lateral brace comprising:

a horizontal member having a first end, a second end, and a horizontal member web, each of the first end and the second end having a connection plate, the connection plate at the second end further comprising a first connection flange;

a diagonal member having a first end, a second end, and a diagonal member web, each of the first end and the second end having a connection plate, the connection plate at the second end further comprising a second connection flange, and the diagonal member web disposed in substantially the same plane as the horizontal member web; and an adjustable hinge operatively connecting the horizontal member and the diagonal member, the adjustable hinge disposed at an interface between the first connection flange and the second connection flange such that the hinge promotes angular movement of the horizontal member in relation to the diagonal member in a plane substantially parallel to the plane of the horizontal member web and the diagonal member web.

2. The adjustable lateral brace of claim 1, wherein the horizontal member further comprises a first flange and a second flange, the first flange and the second flange separated by the horizontal member web.

3. The adjustable lateral brace of claim 2, wherein an interface between the first flange and the horizontal web member and an interface between the second flange and the horizontal web member comprise a fold line for cold-forming the adjustable lateral brace, the fold line disposed on a sheet metal pattern for the adjustable lateral brace.

4. The adjustable lateral brace of claim 3, wherein the diagonal member further comprises a first flange and a second flange, the first flange and the second flange separated by the diagonal member web.

5. The adjustable lateral brace of claim 4, wherein an interface between the first flange and the diagonal web member and an interface between the second flange and the diagonal web member comprise a fold line for cold-forming the adjustable lateral brace, the fold line disposed on a sheet metal pattern for the adjustable lateral brace.

6. The adjustable lateral brace of claim 3, wherein an interface between the connection plate at the horizontal member second end and the first connection flange comprises a fold line for cold-forming the adjustable lateral brace, the fold line disposed on a sheet metal pattern for the adjustable lateral brace.

7. The adjustable lateral brace of claim 3, wherein an interface between the connection plate at the diagonal member second end and the first connection flange comprises a fold line for cold-forming the adjustable lateral brace, the fold line disposed on a sheet metal pattern for the adjustable lateral brace.

8. The adjustable lateral brace of claim 2, wherein the diagonal member further comprises a first flange and a second flange, the first flange and the second flange separated by the diagonal member web.

9. The adjustable lateral brace of claim 8, wherein an interface between the first flange and the diagonal web member and an interface between the second flange and the diagonal web member comprise a fold line for cold-forming the adjustable lateral brace, the fold line disposed on a sheet metal pattern for the adjustable lateral brace.

10. The adjustable lateral brace of claim 2, wherein an interface between the connection plate at the horizontal member second end and the first connection flange comprises a fold line for cold-forming the adjustable lateral brace, the fold line disposed on a sheet metal pattern for the adjustable lateral brace.

11. The adjustable lateral brace of claim 2, wherein an interface between the connection plate at the diagonal member second end and the first connection flange comprises a fold line for cold-forming the adjustable lateral brace, the fold line disposed on a sheet metal pattern for the adjustable lateral brace.

12. The adjustable lateral brace of claim 1, wherein the diagonal member further comprises a first flange and a second flange, the first flange and the second flange separated by the diagonal member web.

13. The adjustable lateral brace of claim 12, wherein an interface between the first flange and the diagonal web member and an interface between the second flange and the diagonal web member comprise a fold line for cold-forming the adjustable lateral brace, the fold line disposed on a sheet metal pattern for the adjustable lateral brace.

14. The adjustable lateral brace of claim 13, wherein an interface between the connection plate at the horizontal member second end and the first connection flange comprises a fold line for cold-forming the adjustable lateral brace, the fold line disposed on a sheet metal pattern for the adjustable lateral brace.

15. The adjustable lateral brace of claim 14, wherein an interface between the connection plate at the diagonal member second end and the first connection flange comprises a fold line for cold-forming the adjustable lateral brace, the fold line disposed on a sheet metal pattern for the adjustable lateral brace.

16. The adjustable lateral brace of claim 13, wherein an interface between the connection plate at the diagonal member second end and the first connection flange comprises a fold line for cold-forming the adjustable lateral brace, the fold line disposed on a sheet metal pattern for the adjustable lateral brace.

17. The adjustable lateral brace of claim 12, wherein an interface between the connection plate at the horizontal member second end and the first connection flange comprises a fold line for cold-forming the adjustable lateral brace, the fold line disposed on a sheet metal pattern for the adjustable lateral brace.

18. The adjustable lateral brace of claim 12, wherein an interface between the connection plate at the diagonal member second end and the first connection flange comprises a fold line for cold-forming the adjustable lateral brace, the fold line disposed on a sheet metal pattern for the adjustable lateral brace.

19. The adjustable lateral brace of claim 1, wherein an interface between the connection plate at the horizontal member second end and the first connection flange comprises a fold line for cold-forming the adjustable lateral brace, the fold line disposed on a sheet metal pattern for the adjustable lateral brace.

20. The adjustable lateral brace of claim 1, wherein an interface between the connection plate at the diagonal member second end and the first connection flange comprises a fold line for cold-forming the adjustable lateral brace, the fold line disposed on a sheet metal pattern for the adjustable lateral brace.

* * * * *